US007278264B2

(12) United States Patent
Brostow

(10) Patent No.: US 7,278,264 B2
(45) Date of Patent: Oct. 9, 2007

(54) PROCESS TO CONVERT LOW GRADE HEAT SOURCE INTO POWER USING DENSE FLUID EXPANDER

(75) Inventor: Adam Adrian Brostow, Emmaus, PA (US)

(73) Assignee: Air Products and Chemicals, Inc., Allentown, PA (US)

( * ) Notice: Subject to any disclaimer, the term of this patent is extended or adjusted under 35 U.S.C. 154(b) by 365 days.

(21) Appl. No.: 11/095,281

(22) Filed: Mar. 31, 2005

(65) Prior Publication Data

US 2006/0225423 A1 Oct. 12, 2006

(51) Int. Cl.
*F01K 25/08* (2006.01)

(52) U.S. Cl. ..... 60/651; 60/671

(58) Field of Classification Search ..... 60/640, 60/651, 671

See application file for complete search history.

(56) References Cited

U.S. PATENT DOCUMENTS 3,950,949 A 4/1976 Martin et al.
4,182,127 A 1/1980 Johnson
5,564,290 A 10/1996 Bonaquist et al.
6,333,445 B1 * 12/2001 O'Brien ..... 585/809
6,357,258 B1 * 3/2002 Mahoney et al. ..... 62/643
6,560,989 B1 * 5/2003 Roberts et al. ..... 62/623
6,742,357 B1 * 6/2004 Roberts ..... 62/612
6,763,680 B2 7/2004 Fischer et al.

FOREIGN PATENT DOCUMENTS

EP 1 389 672 2/2004

* cited by examiner

*Primary Examiner*—Hoang Nguyen
(74) *Attorney, Agent, or Firm*—Willard Jones, II

(57) ABSTRACT

A process to convert heat into power is set forth wherein, to make the cycle more suitable to low grade heat, the working fluid remains substantially in the liquid state after being heat exchanged against the heat source and a dense fluid expander is used in place of a conventional vapor expander to subsequently work expand the liquid working fluid.

10 Claims, 2 Drawing Sheets

PROCESS TO CONVERT LOW GRADE HEAT SOURCE INTO POWER USING DENSE FLUID EXPANDER

BACKGROUND OF THE INVENTION

Heat can be converted into power by the well known Rankine cycle as follows:

Step 1: pumping a liquid working fluid to an elevated pressure;

Step 2 heating the resulting elevated pressure liquid working fluid by indirect heat exchange against the heat source where said heating results in:

(a) boiling the working fluid; and (b) preferably superheating the boil-off to a sufficient degree to ensure the working fluid remains substantially in the vapor state throughout step 3's work expansion step;

Step 3: work expanding (defined herein as expanding at substantially constant entropy) the resulting heated working fluid in a turbine expander;

Step 4: condensing the work expanded working fluid by heat exchange against cooling water to prepare the working fluid for a new cycle of steps 1 through 3.

In one variation (hereafter, the supercritical variation such as supercritical steam cycle), the liquid working fluid is pumped to a supercritical pressure (i.e. a pressure above the liquid's critical pressure) in step 1 and heated to a supercritical temperature (i.e. a temperature above the liquid's critical temperature) in step 2.

In another variation, the thermodynamic efficiency of step 3's work expansion step is increased by using a multi-stage expander where the working fluid is re-heated against the heat source between stages.

In another variation, the working fluid is preheated against a low grade heat source prior to boiling the working fluid against a higher grade heat source (See for example U.S. Pat. No. 3,950,949 and U.S. Pat. No. 4,182,127).

The present invention differs from the conventional application of the Rankine cycle in a significant way. In particular, instead of requiring the heat source to be of sufficiently high temperature or "high grade" to boil/superheat the working fluid in step 2 (or heat working fluid to supercritical temperature in case of supercritical cycle), a dense fluid expander is utilized in step 3.

In this fashion, the working fluid is allowed to be a liquid at the end of step 2 (or at least mostly a liquid as there are dense fluid expanders that can tolerate some vapor at the inlet) resulting in an expander discharge at the end of step 3 containing a vapor portion and a (typically bigger) liquid portion. Accordingly, the present invention is suitable for relatively low temperature (typically 100° C. or less) or "low grade" heat sources (often referred to as "waste heat") that are incapable of boiling/superheating the working fluid in step 2 (or heat heating working fluid to supercritical temperature in case of supercritical cycle). Or at least incapable of providing such an amount of heat while still allowing, as required in step 4, the expanded working fluid to be condensed without any refrigeration beyond ordinary cooling water.

In addition to its applicability to low grade heat, the present invention also avoids the thermodynamic penalty associated with employing a boiling liquid to recover heat. (See for example EP 1389672 which utilizes boiling fluid to recover low grade heat of compression.) In particular, since a liquid (or a least a single component liquid) boils at a constant temperature, the associated heat exchanger has large temperature differences between the hot and cold streams (i.e. very non "tight" cooling curves) which the present invention avoids. (Although the supercritical variation of the Rankine cycle also avoids this thermodynamic penalty associated with employing a boiling liquid to recover heat, if the fluid's critical temperature is below the temperature of the low grade heat source, the liquid condensed at the cooling water temperature is relatively close to the fluid's critical temperature and consequently the pump work will be too high relative to the expander work for the cycle to be efficient.)

Of course, as the skilled practitioner can readily appreciate, there is a thermodynamic (and mechanical complexity) penalty associated with the present invention's work expansion of a gas vis-à-vis the conventional work expansion of a vapor. However, recent advances in dense fluid expanders, coupled with the ever increasing energy costs, are working to justify the present invention's use a dense fluid expander to convert low grade heat sources into power. Examples of such low grade heat include compressor discharge, geothermal sources (such as hot spring) and the heat from solar collectors.

Heretofore, the application of two-phase dense fluid expanders has been limited to refrigeration cycles where, prior to work expanding the working fluid, the working fluid is cooled (e.g. to take advantage of refrigeration producing effect when a fluid is work expanded) instead of heated as in present cycle (e.g. to take advantage of work producing effect when a fluid is work expanded). For example, U.S. Pat. No. 5,564,290 teaches use of a two-phase dense fluid expander in an air separation plant. U.S. Pat. No. 6,763,680 teaches expanding liquid natural gas in a two-phase dense fluid expander. Two-phase dense fluid expanders have also been proposed in a standard vapor compression refrigeration cycle as a replacement for a throttle (Joule-Thompson) valve.

BRIEF SUMMARY OF THE INVENTION

The present invention is a process to convert heat into power wherein, to make the process more suitable to low grade heat, the working fluid remains substantially in the liquid state after being heat exchanged against the heat source and a dense fluid expander is used in place of a conventional vapor expander to subsequently work expand the liquid working fluid.

DETAILED DESCRIPTION OF THE INVENTION

The present invention is a process to convert a heat source into power comprising:

Step 1: pumping a liquid working fluid to an elevated pressure;

Step 2: heating the resulting elevated pressure liquid working fluid by indirect heat exchange against the heat source wherein, at the end of this step 2, the working fluid remains substantially in the liquid state;

Step 3: work expanding the resulting heated working fluid in a dense fluid expander to generate a low pressure liquid, a low pressure gas and said power; and Step 4: condensing the low pressure gas from step 3 by indirect heat exchange against a cooling fluid and re-combining the resultant condensed low pressure gas with the low pressure liquid from step 3 to prepare the working fluid for a new cycle of steps 1 through 3.

As used herein, the term liquid is primarily intended to refer to a subcritical liquid (i.e. a liquid below both its critical pressure and critical temperature). Accordingly, in one embodiment of the present invention, the liquid is a subcritical liquid throughout the entire cycle.

However, the use of a "supercritical liquid" (defined herein as fluid at supercritical pressure but subcritical temperature) is also within the scope of the present invention. Accordingly, in another embodiment of the present invention (hereafter, the partial supercritical embodiment), the liquid working fluid is pumped to a supercritical pressure in step 1 and heated to a temperature below its supercritical temperature in step 2. (Contrast this partial supercritical embodiment with supercritical variation of Rankine cycle discussed under Background section where the supercritical pressure working fluid from step 1 is heated to a temperature above its supercritical temperature in step 2).

In another embodiment of the present invention, the heat source is at temperature below 200 F.

In another embodiment of the present invention, the heat source is at low grade heat source comprising the discharge from a compressor.

In another embodiment of the present invention, the cooling fluid used in step 4 comprises cooling water.

In another embodiment of the present invention, the working fluid comprises ammonia.

In another embodiment of the present invention, the working fluid comprises at least two components mixed together.

Figure 1:
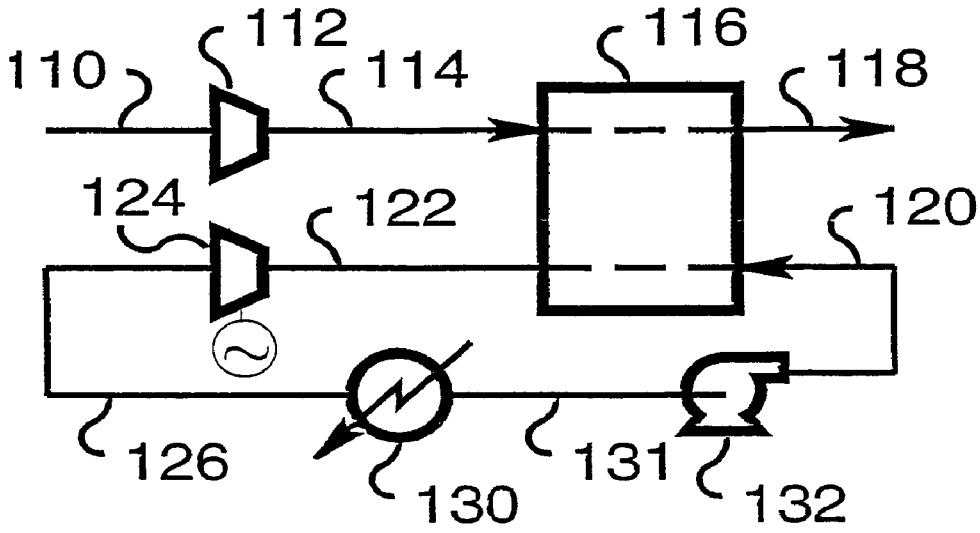
FIG. 1 is a schematic drawing of one embodiment of the present invention.

Referring to the embodiment of the present invention depicted in FIG. 1, gas stream 110 is compressed in compressor 112, resulting hot steam 114 is cooled in the heat recovery exchanger 116, and exits the exchanger as stream 118. Liquid working fluid 120 is heated in 116 by indirect heat exchange against stream 114. The resulting substantially liquid stream 122 is expanded in a two-phase dense fluid expander 124 to produce stream 126 containing mostly liquid with some vapor. Stream 126 is completely condensed in condenser 130. The resulting liquid 131 is pumped in pump 132 to produce stream 120. Compressor 112 can be single-stage or multiple stages with intercoolers or without intercoolers (adiabatic compression). The power recovery system can be present from the beginning or added as a retrofit.

Figure 2:
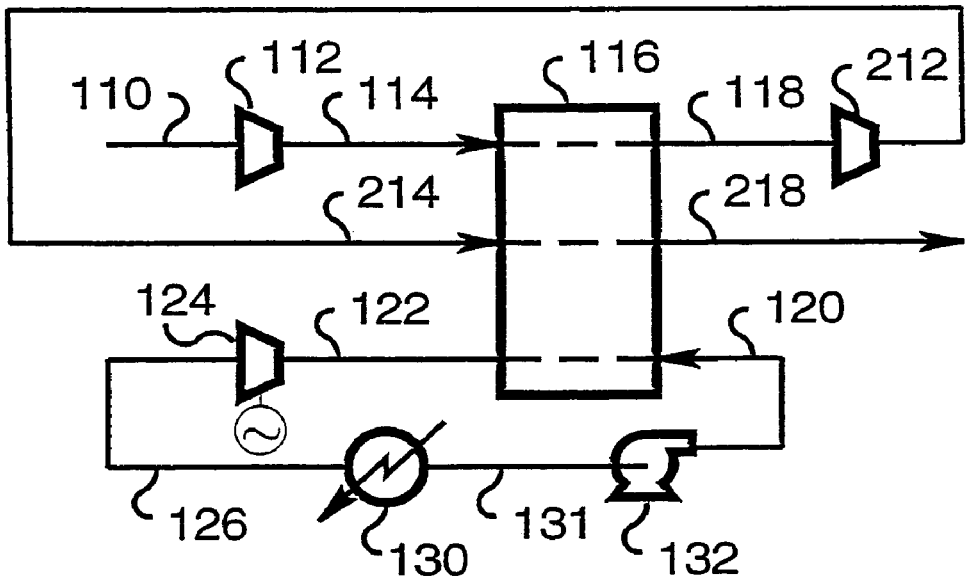
FIG. 2 is a schematic drawing of another embodiment of the present invention.

FIG. 2 is similar to FIG. 1's embodiment (corresponding streams and equipment are identified with same numbers) except the heat is recovered from a multiple stage compressor. In particular, compressed, cooled gas stream 118 is now compressed for the second time in compressor 212. The resulting hot stream 214 is cooled in 116 and exits the exchanger as stream 218. Multiple heat exchangers can be used in place of a single exchanger 116 with working fluid distributed between the exchangers.

Figure 3:
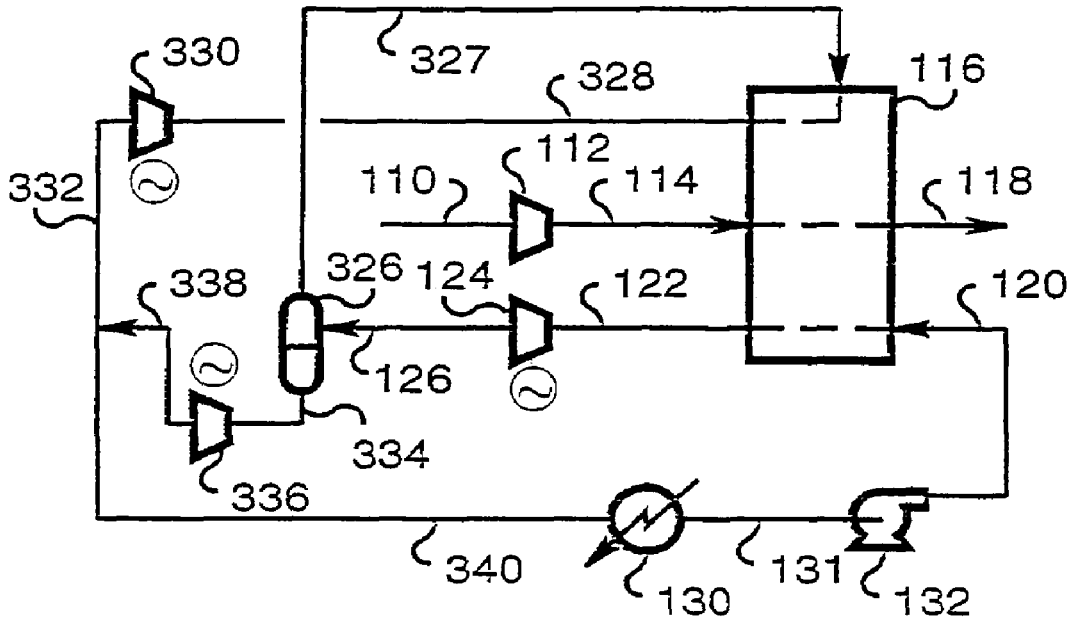
FIG. 3 is a schematic drawing of another embodiment of the present invention.

FIG. 3 is similar to FIG. 1's embodiment (corresponding streams and equipment are identified with same numbers) except a vapor portion of 126, now at an intermediate pressure, is separated in phase separator 326 to produce vapor stream 327 and liquid stream 324. Vapor stream 327 is reheated in 116 and expanded in vapor expander 330 to generate additional power and produce stream 332. Liquid stream 334 is expanded in additional dense fluid expander 336 to generate more power to produce stream two-phase stream 338. Streams 332 and 338 are combined to produce stream 340 that is completely condensed in condenser 130.

Figure 4:
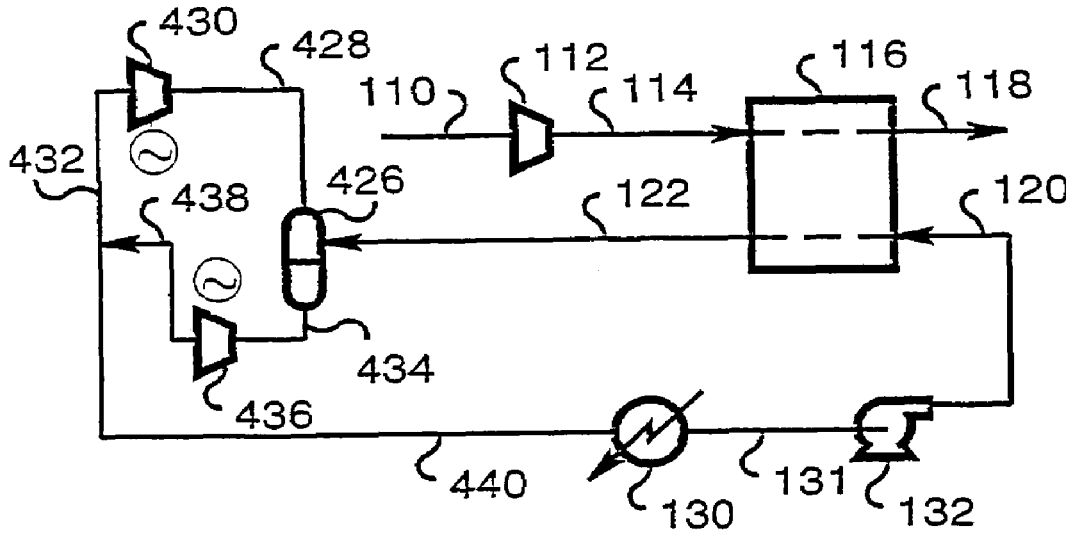
FIG. 4 is a schematic drawing of another embodiment of the present invention.

FIG. 4 is similar to FIG. 1's embodiment (corresponding streams and equipment are identified with same numbers) except a vapor portion of stream 122, after being separated in phase separator 426, is expanded in vapor expander 430 to generated additional power and produce stream 432. The liquid portion 434 is expanded in dense fluid expander 436 to generate more power to produce stream two-phase stream 438. Streams 432 and 438 are combined to produce stream 440 that is completely condensed in condenser 130.

The configurations shown in FIGS. 3 and 4 recover slightly more power than the configuration shown in FIG. 1 and may also help overcome mechanical limitations of how much vapor can be allowed at the discharge of a dense fluid expander. Current expander designs that allow a two-phase mixture at the inlet would allow one to eliminate phase separator 426 and additional vapor expander 430.

The following example based on FIG. 1 is offered to demonstrate the efficacy of the present invention. Dry air at rate of 1000 lb mole/hr (28,960 lb/hr) is compressed in a single-stage compressor from 14.7 psia at 70 F to 26.46 psia (compression ratio of 1.8). The compressor's adiabatic efficiency is 85% while the brake horsepower is 311.2. The compressed air, now at 183.8 F, goes to a heat recovery exchanger where it is cooled down to 78.6 F against liquid ammonia. Liquid ammonia enters the heat recovery exchanger at the rate of 390.8 lb mole/hr (5953.0 lb/hr), 628.6 psia, and 72.1 F and is heated to 179.7 F by indirect heat exchange with above-mentioned air stream. The cooling curves in the heat exchanger are tight with the logarithmic mean temperature difference of 3.3 F.

Hot liquid ammonia is then expanded in a dense fluid expander down to 128.7 psia. It is now at 70 F and contains 25.3% vapor on molar basis. The expander adiabatic efficiency is 75%; brake horsepower is 24.0. The partially flashed low pressure ammonia is completely condensed in a condenser against cooling water (cooling water or other coolant's temperature determines expander's outlet pressure), pumped to 628.6 psia, and introduced to the heat recovery exchanger to close the cycle. The pump's adiabatic efficiency is 85%; brake horsepower is 5.5.

The net power recovered is equal to the power generated by the expander minus the power consumed by the pump. It is 18.5 HP or 5.9% of the original power of compression. The impact of equipment pressure drops (neglected in this example) is not expected to significantly change this number.

The invention claimed is:

1. A process to convert a heat source into power comprising:

Step 1: pumping a liquid working fluid to an elevated pressure;

Step 2: heating the resulting elevated pressure liquid working fluid by indirect heat exchange against the heat source wherein, at the end of this step 2, the working fluid remains substantially in the liquid state;

Step 3: work expanding the resulting heated working fluid in a dense fluid expander to generate a low pressure liquid, a low pressure gas and said power; and Step 4: condensing the low pressure gas from step 3 by indirect heat exchange against a cooling fluid and re-combining the resultant condensed low pressure gas with the low pressure liquid from step 3 to prepare the working fluid for a new cycle of steps 1 through 3.

2. The process of claim 1 wherein the liquid is a subcritical liquid throughout the entire cycle.

3. The process of claim 1 wherein, the liquid working fluid is pumped to a supercritical pressure in step 1 and heated to a temperature below its supercritical temperature in step 2.

4. The process of claim 1 wherein the heat source is at temperature below 200 F.

5. The process of claim 1 where the heat source is a low grade heat source comprising the discharge from a compressor.

6. The process of claim 1 wherein the cooling fluid used in step 4 comprises cooling water.

7. The process of claim 1 wherein the working fluid comprises ammonia.

8. The process of claim 1 wherein the working fluid comprises at least two components mixed together.

9. The process of claim 1 wherein step 3 comprises:

a) work expanding the heated working fluid from step 2 to an intermediate pressure in a first dense fluid expander to generate an intermediate low pressure liquid, an intermediate low pressure gas and a portion of said power;

b) separating the intermediate low pressure liquid from the intermediate low pressure liquid;

c) heating the intermediate low pressure vapor by indirect heat exchange against the heat source; and d) further work expanding the intermediate low pressure vapor in a vapor expander to generate a second portion of said power and the low pressure vapor that is condensed in step 4; and e) further work expanding the intermediate low pressure liquid in a second dense fluid expander to generate a third portion of said power and the low pressure liquid that is re-combined with the condensed low pressure vapor in step 4.

10. The process of claim 1 wherein a portion of the working fluid is vaporized in step 2 and separately work expanded in a vapor expander to generate a portion of said power.

* * * * *